United States Patent [19]

Gagnebin et al.

[11] Patent Number: 4,970,708

[45] Date of Patent: Nov. 13, 1990

[54] WATCH CASE INCLUDING A HOLLOWED-OUT CASEBAND

[75] Inventors: Gaston Gagnebin; Eric Loth, both of Bienne, Switzerland

[73] Assignee: Omega S.A., Bienne, Switzerland

[21] Appl. No.: 468,359

[22] Filed: Jan. 22, 1990

[30] Foreign Application Priority Data

Jan. 23, 1989 [CH] Switzerland ..... 00188/89

[51] Int. Cl.[5] ..... G04B 37/00

[52] U.S. Cl. ..... 368/300; 368/281

[58] Field of Search ..... 368/280–282, 368/299–300

[56] References Cited

U.S. PATENT DOCUMENTS

| | | | |
|---|---|---|---|
| 221,155 | 11/1979 | Colby et al. | 368/280 |
| 4,204,396 | 5/1980 | Breguet | 368/280 |
| 4,757,485 | 7/1985 | Man | 368/281 |

FOREIGN PATENT DOCUMENTS

| | | | |
|---|---|---|---|
| 7040507 | 10/1970 | Fed. Rep. of Germany . | |
| 319635 | 4/1957 | Switzerland . | |
| 13993 | 3/1964 | Switzerland . | |
| 385749 | 3/1965 | Switzerland . | |
| 3258 | 12/1975 | Switzerland . | |
| 0634454 | 2/1983 | Switzerland | 368/280 |

*Primary Examiner*—Bernard Roskoski

*Attorney, Agent, or Firm*—Griffin, Branigan & Butler

[57] ABSTRACT

The watch case of this invention includes a caseband (1) hollowed out in the form of a vault (10). Such caseband includes first (5) and second (6) cylindrical support surfaces cooperating respectively with a crystal (2) and a back cover (3). Three blocks (7), unitary with the caseband, are arranged within the hollowed-out vault-like space. Each block bears a projection (11) extending towards the movement (17) borne by the case, said projection having an upper snap (12) on which rests a flange (15) supporting the crystal and a lower snap (13) on which rests a casing ring (16) on which the back cover bears.

10 Claims, 2 Drawing Sheets

WATCH CASE INCLUDING A HOLLOWED-OUT CASEBAND

This invention concerns a watch case including a caseband and a plurality of components together defining a housing intended to receive a watch movement and display means in which the components comprise a crystal and a back cover and in which the caseband exhibits a recess opening towards the interior of the case, a first support surface cooperating with the crystal and a second support surface cooperating with the back cover.

BACKGROUND OF THE INVENTION

The patent document CH-A-66541 describes a hollowed out caseband enclosing a watch movement. This caseband also exhibits a first support surface cooperating with a crystal and a second support surface cooperating with a back cover. These first and second support surfaces however are not cylindrical but conical, since crystal and back cover are snap fitted onto the caseband. Furthermore, the movement is maintained in place within the caseband without the help of blocks which would take up space in the recess of the caseband as will appear in the present invention. The construction proposed in the cited document is above all intended for a pocket watch in which no particular arrangement is made in order to diminish the thickness of the watch or to reduce to a minimum the weight of the material making up the caseband, as is the case in the invention to be described, where the caseband may be formed of precious metal in diminishing as much as possible the weight of this metal.

SUMMARY OF THE INVENTION

Thus, the watch case in accordance with the invention, in addition to including the characteristics given in the opening paragraph, is characterized by the fact that the first and second support surfaces are cylindrical and define openings in which the crystal and back cover are respectively engaged, and by the fact that at least three blocks unitary with the caseband are arranged in the space defined by said recess and are adapted to position at least one of said components axially.

The invention will now be set forth in the description to follow given by way of non-limiting example and in referring to the drawings showing an embodiment thereof.

DESCRIPTION OF THE PREFERRED EMBODIMENT

Figure 1:
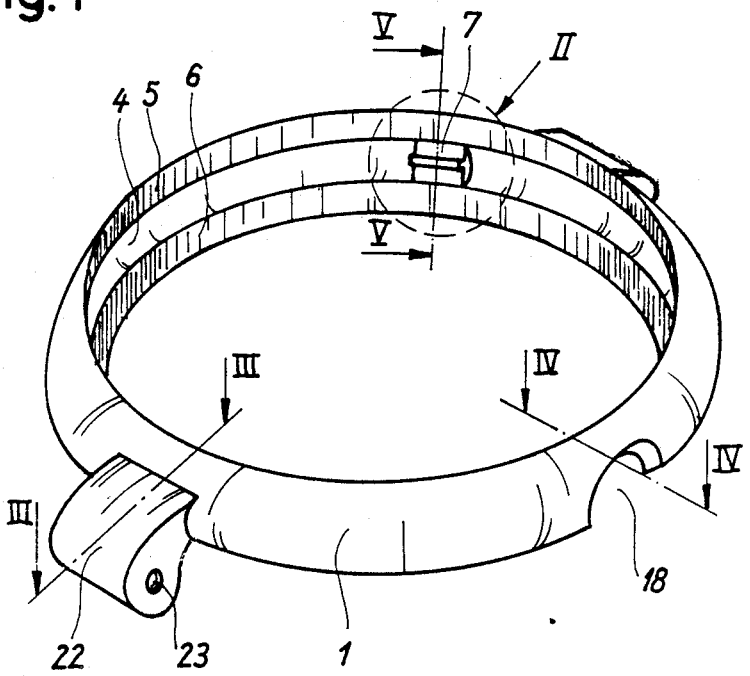
FIG. 1 is a perspective view showing the watch case according invention where only the caseband has been shown block.
Figure 5:
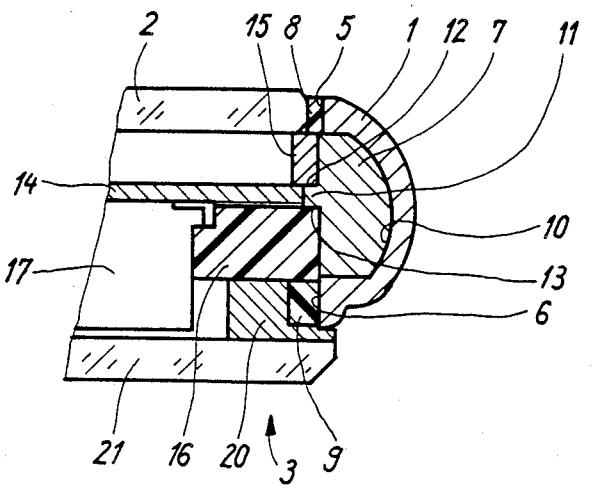

Reference will be had initially to FIGS. 1 and 5. In these figures, the watch case includes a caseband 1 and a plurality of components comprising a crystal 2 and a back cover 3. This watch case is intended to accommodate a watch movement 17 and display means for the time of day only the dial 14 of which here. As may be seen best on figure 1, the caseband 1 exhibits a recess 4 opening towards the interior of the case, a first support surface 5 which cooperates with crystal 2 and a second support surface 6 which cooperates with back cover 3. In particular, and according to a first characteristic of the invention, the first and second support surfaces 5 and 6 are cylindrical in the sense that they are oriented in the sense of the watch case axis. These support surfaces thus define openings in which the crystal and the back cover are respectively engaged. According to a second important characteristic of the invention, at least three blocks 7 are unitary with the caseband 1 and are arranged in the space defined by the recess 4. A single one of these blocks is visible on figure 1 situated approximately at 11 o'clock of the timepiece. As will be explained in detail hereinafter, each of these blocks 7 is formed and adapted in order to position axially at least one of the components comprising the crystal and the back cover.

Figure 2:
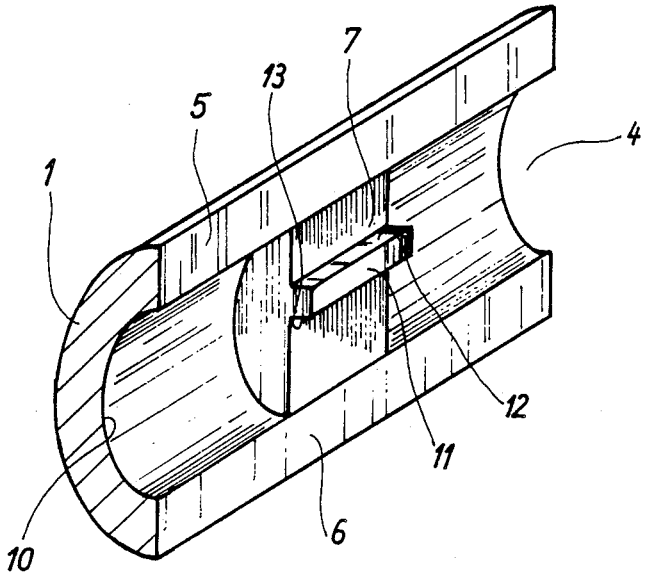
FIG. 2 is an enlargement of zone II visible on FIG. 1.

FIG. 2 is an enlargement of zone II visible on FIG. 1. There one recognizes in particular a portion of the caseband 1 and one of the three blocks 7 confined to the interior of the recess 4. The block 7 may either be attached within the recess 4 or may be integrally formed with the caseband 1. In the first case the block may be welded in the bottom of the recess, although any other attaching means as for instance gluing, may likewise be envisaged. In the second case, one begins with a massive caseband without hollowing and by means of a milling cutter exhibiting a profile resembling that of the recess, one machines the caseband in removing the milling cutter at the three places where the blocks must be present.

The watch case shown as an example in FIG. 1 has a round caseband and the recess 4 is in the form of an arch 10 as may readily be seen on FIGS. 2 to 5. This manner of manufacture is particularly well adapted to watch cases the caseband of which is of gold since it contributes to diminish in a substantial manner the weight of the gold and consequently to diminish the cost of the watch. The invention could however be applied to a watch other than of round form with the same advantages indicated hereinabove. One will note also that the recess in the form of a vault contributes to rigidify the caseband more than if it were made without hollowing out.

Figure 3:
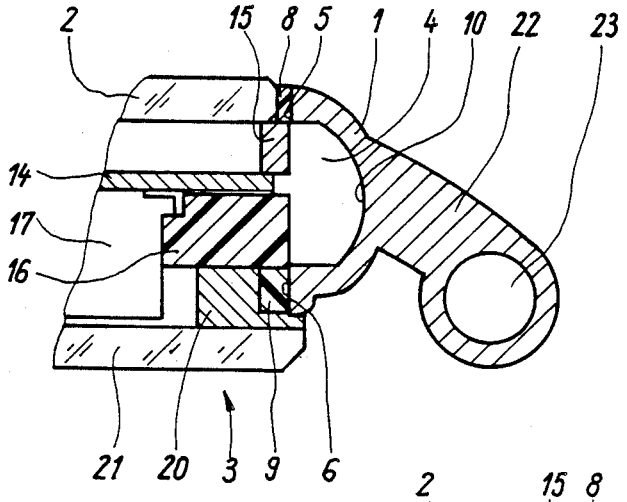
FIGS. 3, 4 and 5 are cross-sections along lines III—III, IV—IV and V—V visibly respectively on figure 1 and in which one supposes the watch case to be entirely assembled.
Figure 4:
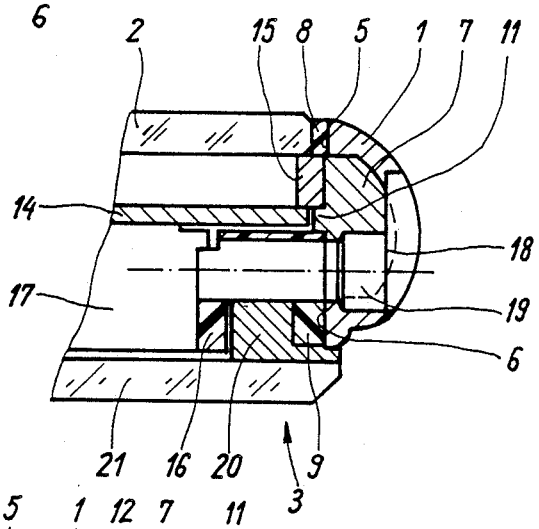

As may be seen on FIGS. 3, 4 and 5, moisture proofing of the watch case is assured by seals. To this effect one may arrange a first seal 8 between crystal 2 and the first support surface 5 and a second seal 9 between back cover 3 and the second support surface 6.

It has already been mentioned that the blocks 7 were formed and adapted so as to position axially at least one of the components comprising crystal and back cover.

To this end and referring now to FIGS. 2, 4 and 5, there will be seen the block 7 bearing a projection 11 extending beyond the recess 4 and in the direction of the movement 17. The axial positioning of the crystal 2 is brought about thanks to an upper snap 12 present on the projection 11. On such upper snap 12 there rests a flange 15 against which the crystal 2 is supported, the flange serving to assure a well defined distance between the dial 14 and the bottom of the crystal 2 and to leave thus a free space for the hands (not shown). In order to assemble the crystal one employs the caseband 1 provided with its blocks 7, such blocks being preferably arranged at 11 o'clock, at 3 o'clock and at 7 o'clock. The flange 15 is introduced from above and comes to rest on the upper snaps 12 of the projections 11 of blocks 7. Next the annular seal 8 is put into place and the crystal 2 is driven to the interior of the seal to the point where said crystal is brought to bear on the flange, this latter bearing in turn on the projection 11. At the end of this operation, the edge section of the crystal compresses the seal 8 against the support surface 5 in order to assure sealing of the watch.

Although such may be effected in another manner, one may likewise employ the same projection 11 in order to axially position the back cover 3. As may be particularly well seen on FIGS. 2 and 5, the projection 11 from block 7 bears a lower snap 13 on which rests a casing ring 16 against which the back cover 3 bears. The casing ring is adapted in order to maintain the movement 17 in place, this movement resting in a known manner within a housing provided within the casing ring. Likewise in a well known manner, the movement is fastened to the casing ring by braces just as the dial 14 is fastened to the movement by dial feet. Thus, in order to assemble the movement into the case, the movement 17 with its contiguous casing ring 16 is introduced from below the caseband 1 up to the point where the casing ring 16 comes to rest on the lower snap 13 of the projection 11. Next one introduces the annular seal 9 and drives the back cover 3 towards the interior of the seal to the point where said back cover 3 comes to bear on the casing ring 16, this latter bearing in turn on projection 11. At the end of this operation, the edge section of the back cover compresses seal 9 against the support surface 6 in order to assure sealing of the watch case.

The embodiment shown demonstrates a back cover 3 which is an assembly formed of ring 20 and a closing plate 21. Ring and plate may be formed from one single piece or may be connected to one another by means of glue for instance. If the caseband is of gold, the plate will likewise be of gold. However, as has been shown on FIGS. 3 to 5, in order to diminish to a maximum the weight of the gold, the plate may be a second crystal attached to the ring. One thus obtains a gold case which is inexpensive and the weight of which in precious metal may be less than 4 grams. In this case the jeweller's hallmark will be placed on the caseband.

As is shown on FIGS. 1 and 3, the caseband 1 bears attachment means 22 for a bracelet held in place by means of pins passing through holes 23. These lugs may be integrally formed with the caseband or fitted thereafter by means of welding, for instance.

As shown also on FIG. 4, the case provides an opening 18 continued by a bore 19 traversing at the same time block 7 and the casing ring 16 which permits placing a time setting stem, such stem being arranged in a well known manner within its housing by means of a tube and a seal.

Blocks 7 are at least three in number to assure a suitable seating of the components to be assembled. Preferably there will be chosen a span of 10° for the block coinciding with the entry of the stem and 5° for the other two.

It has been shown that the proposed construction enables diminishing as much as possible the weight of gold to be employed whilst assuring a rigid mechanical construction as well as an easy assembly of the watch case.

What we claim is:

1. A watch case including a caseband and a plurality of components together defining a housing intended to receive a watch movement and display means, in which the components comprise a crystal and a back cover and in which the caseband exhibits a recess opening towards the watch case interior, a first support surface cooperating with the crystal and a second support surface cooperating with the back cover, the first and second support surfaces being cylindrical and defining openings in which the crystal and the back cover are respectively engaged, at least three blocks unitary with the caseband being arranged in the space defined by said recess to position at least one of said components axially, each of said blocks bearing a projection extending toward the movement.

2. A watch case as set forth in claim 1 wherein said blocks are welded within the space defined by said recess.

3. A watch case as set forth in claim 1 wherein said blocks are integrally formed with said caseband.

4. A watch case as set forth in claim 1 wherein a first seal is interposed between the crystal and the first support surface and a second seal is interposed between the back cover and the second support surface.

5. A watch case as set forth in claim 1 wherein the caseband is of round form and exhibits a recess in the form of a vault.

6. A watch case as set forth in claim 1 wherein the caseband is formed from gold.

7. A watch case as set forth in claim 1 wherein each projection has an upper snap on which a flange is supported against which the crystal bears.

8. A watch case as set forth in claim 7 wherein said projection bears in addition a lower snap on which a casing ring is supported against which the back cover bears, said casing ring being adapted to maintain the movement in place.

9. A watch case as set forth in claim 8 wherein the back cover is an assembly formed from a ring and a closure plate.

10. A watch case as set forth in claim 9 wherein the closure plate comprises a crystal.

* * * * *